United States Patent [19]

Barnes et al.

[11] 3,939,926

[45] Feb. 24, 1976

[54] PORTABLE EARTH BORING MACHINE

[75] Inventors: Thomas W. Barnes, Franklin; Albert R. Richmond, West Salem, both of Ohio

[73] Assignee: The Richmond Manufacturing Company, Ashland, Ohio

[22] Filed: Nov. 29, 1974

[21] Appl. No.: 528,460

Related U.S. Application Data

[63] Continuation-in-part of Ser. No. 497,245, Aug. 14, 1974.

[52] U.S. Cl. ..... 175/24; 173/2; 175/61; 175/73; 175/45; 299/1

[51] Int. Cl.[2] ..... E21B 7/10

[58] Field of Search ..... 175/24, 26, 61, 62, 73, 175/74; 299/1; 173/2

[56] References Cited

UNITED STATES PATENTS

| | | | |
|---|---|---|---|
| 3,415,329 | 12/1968 | Marlind | 175/73 X |
| 3,526,285 | 9/1970 | Adkins et al. | 175/73 |
| 3,767,836 | 10/1973 | Geis et al. | 175/24 |
| 3,851,716 | 12/1974 | Barnes | 175/45 |
| 3,857,449 | 12/1974 | Kimura | 175/45 X |

FOREIGN PATENTS OR APPLICATIONS

| | | | |
|---|---|---|---|
| 259,009 | 6/1970 | U.S.S.R. | 299/1 |

*Primary Examiner*—Ernest R. Purser
*Assistant Examiner*—Richard E. Favreau
*Attorney, Agent, or Firm*—Palmer Fultz, Esquire

[57] ABSTRACT

A portable earth boring machine for the horizontal boring of shafts and the insertion of pipeline casing sections in installations where excavation from the surface is undesirable. The machine is characterized by a steering head particularly adapted for rock drilling operations which head is positioned at the front of the casing with such steering head being automatically controlled so as to directionally control the direction of extension of the pipeline as the drilling operation progresses.

8 Claims, 8 Drawing Figures

PORTABLE EARTH BORING MACHINE

REFERENCE TO CO-PENDING APPLICATION

This application is a continuation-in-part of co-pending application Serial No. 497,245 filed Aug. 14, 1974.

BACKGROUND OF THE INVENTION

This invention relates to portable earth boring machines and more particularly to a machine adapted for horizontal boring of shafts for the insertion of pipelines at installations where excavation from the surface is undesirable.

SUMMARY OF THE INVENTION

In general, the machine of the present invention comprises a base means that includes spaced track members which are disposed in a trench adjacent to the hill to be bored. The machine further includes a frame means mounted for movement along the track means and such carriage supports a power train for rotating connected sections of auger shafts which comprise a progressively extendable boring auger. The frame means further supports a pusher ring for driving sections of casings into the bored hole and an associated pushing cylinder means is provided for advancing and retracting the frame means and pusher ring along the track means.

In accordance with the present invention the earth boring machine is provided with a novel adjustable steering head which in general comprises a plurality of wedging means which are mounted in circumferentially spaced relationship on the front casing section with the wedging means being selectively extendable and retractable laterally outwardly against the rock surface. The steering head is provided with novel automatic control apparatus for varying the direction and magnitude of the wedging force applied by the wedging means so as to directionally control the path of the pipeline as the boring operation progresses.

As another aspect of the present invention the adjustable steering head is easily fabricated by modifying a standard casing section so as to include a bearing support for the rock boring head as well as the above mentioned steering apparatus.

It is therefore an object of the present invention to provide novel steering head means for automatically controlling the establishment of grade in the boring of pipeline holes in rock formations.

It is another object of the present invention to provide an apparatus of the type described that includes novel remote control apparatus for the steering head.

Further objects and advantages of the present invention will be apparent from the following description, reference being had to the accompanying drawings wherein preferred forms of embodiments of the invention are clearly shown.

DESCRIPTION OF THE PREFERRED EMBODIMENTS

Figures 1, 2:
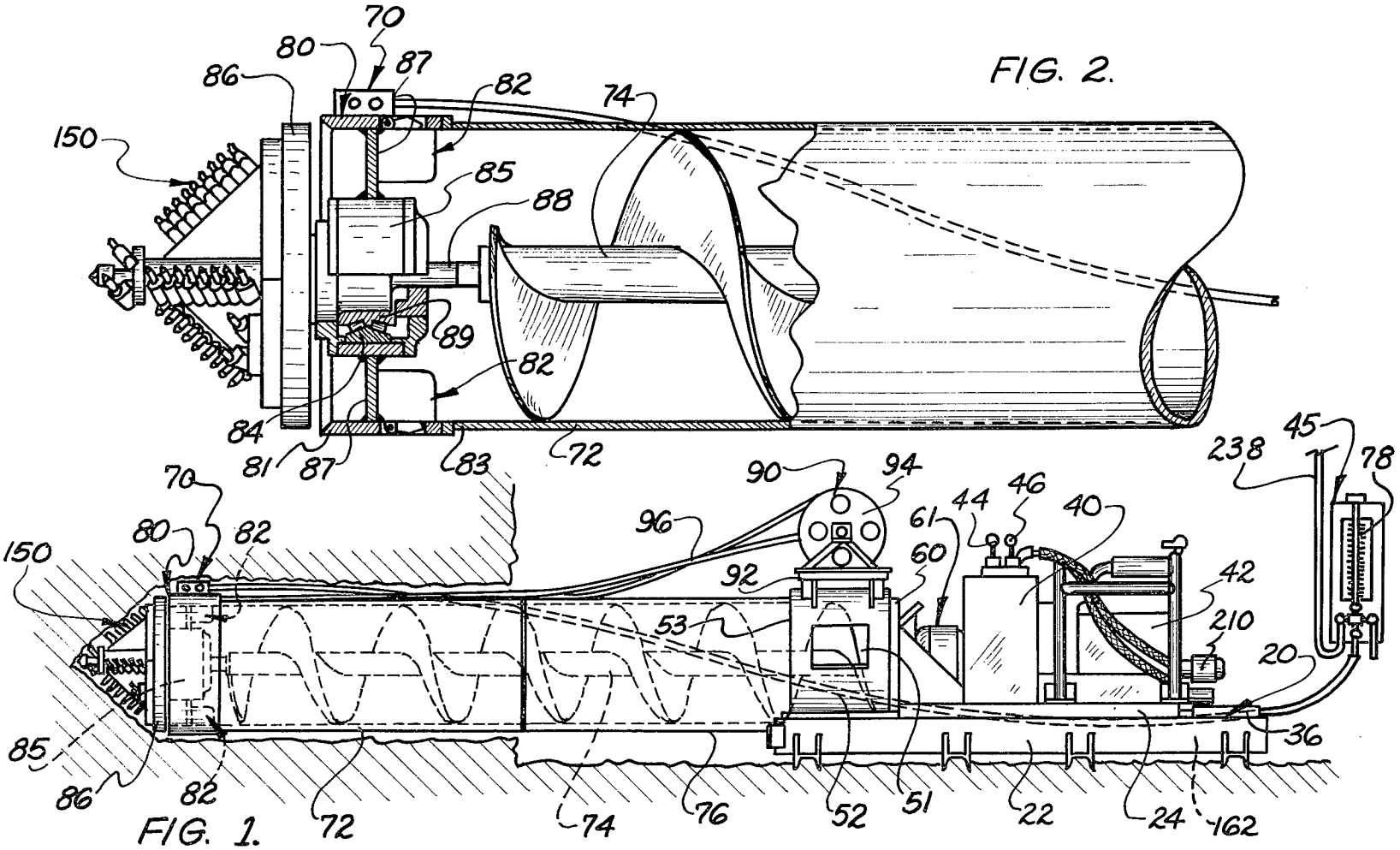
FIG. 1 is a side elevational view of a boring machine constructed in accordance with the present invention.
FIG. 2 is a partial side elevational view of a steering head comprising a portion of the apparatus of FIG. 1.

Referring in detail to the drawings, FIG. 1 illustrates the complete horizontal earth boring machine of the present invention which comprises a base means indicated generally at 20. Such base means includes spaced longitudinally extending track means 22 which support a carriage means indicated generally at 24.

Figure 6:
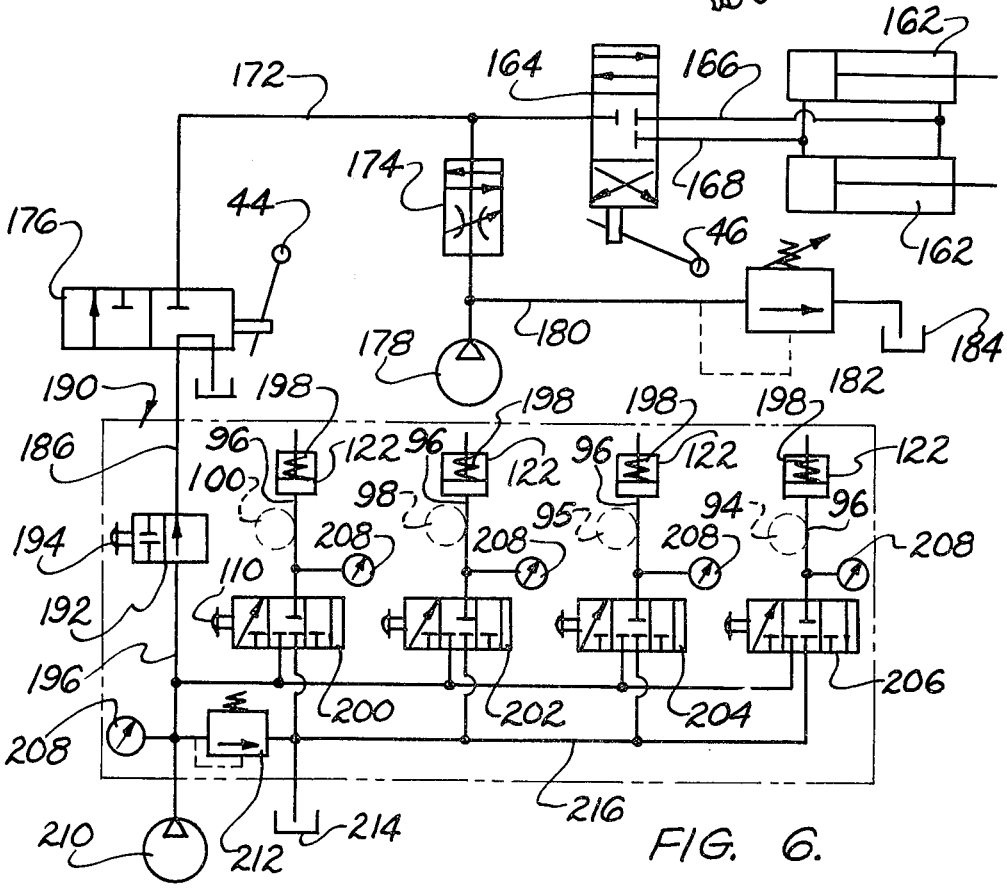
FIG. 6 is a diagrammatic view of a hydraulic control system for the control system of the embodiment of FIGS. 1 and 2.

The carriage means 24 is advanced and retracted along track 22 by a pair of hydraulic pushing cylinders seen at 162 in FIGS. 1 and 6, with such pushing cylinders being operatively connected between a power cylinder base 36 and the carriage means 24.

Details of typical power cylinders such as 162 and power cylinder base 36 are disclosed and described in detail in the application of Albert R. Richmond, Ser. No. 867,816 filed Oct. 20, 1969, now U.S. Pat. No. 3,612,195 issued Nov. 12, 1971.

It will be further seen that pressurized fluid for actuating power cylinders 162 is provided by a fluid power system, FIG. 6, including a pump 210 driven by an engine 42, FIG. 1, with such system being described in detail later herein. The fluid power circuit further includes control valve actuators 44 and 46 which are manually actuated to extend and retract the pushing cylinders 162 to move carriage 24 forwardly or rearwardly along the track means 22.

Referring again to FIG. 1, the boring machine further includes a pusher ring 52 including a front annular surface 53 for engaging the sections of pipe casing for pushing such sections into the bored hole. Such pusher ring 52 includes a thrust plate means 60 mounted on the carriage means for absorbing the pushing thrust and the boring thrust of the auger assembly 74. A hydraulic drive assembly 61 is interposed between engine 42 and auger assembly 74, such hydraulic drive arrangement being described in co-pending application Ser. No. 337,211 filed Mar. 1, 1973, now U.S. Pat. No. 3,870,110.

A typical auger construction for connection with the machine of the present invention is disclosed and described in detail in the application of Albert R. Richmond, Ser. No. 85,614, filed Oct. 30, 1970, now U.S. Pat. No. 3,693,734 issued Sept. 26, 1972.

Reference is next made to the remote grade indicating apparatus of the present invention which is shown in assembled relationship with the boring machine in FIG. 1 and which comprises a sensing means indicated generally at 70 which is mounted on the foremost casing portion 72. The apparatus further includes a gauge means indicated generally at 45, which gauge means is located at the operator's station of the boring machine, as seen in FIG. 1. This serves to continuously provide read-out information with respect to deviation in the inclination or declination of the bored hole as the drilling operation progresses.

Details of the remote grade indicating apparatus are described and disclosed in detail in the co-pending application of Thomas W. Barnes, Ser. No. 354,998 filed Apr. 27, 1973 now U.S. Pat. No. 3,851,716.

In the present application of the remote grade indicating apparatus the fluid conduit connection between the sensing means 70 and gauge 45 is provided by a flexible line 75.

In general, the remote grade indicating apparatus 45–70 functions in accordance with the principle that liquid in a conduit system will seek a common level and since water is present in the sensing means and also in the visual gauge tube 78 of gauge 45 the level of the liquid in the gauge tube will always be the same as the level of the liquid in the sensing means 70. Hence it will be understood that by reading the level in the liquid tube 78, provided with grade indicia above and below a zero datum, the operator can at any time determine the height of the boring auger and steering head with respect to a predetermined datum line.

Reference is next made to the steering head apparatus of the present invention with the remote control embodiment being shown installed on the machine of FIG. 1 and illustrated in enlarged detail in FIGS. 2, 3, 5, and 6. The steering head apparatus is indicated generally at 80 and is installed on a modified standard front casing section 72 and includes a heavy duty housing ring 81 of heavy tubular steel material which is joined to the front end of the casing section at a weld 83 as best seen in FIG. 2.

A plurality of radially extending spaced legs 87 rigidly support a central bearing means 85, the latter including a housing that contains a tapered roller bearing assembly 89. Such bearing means rotatably supports a rock head mounting shaft 88 including a front head mounting plate 86 on which is removably mounted a rock bit indicated generally at 150 with a typical rock bit being disclosed and described in detail in U.S. Pat. No. 3,693,734.

As seen in FIG. 2 rock head mounting shaft 88 is removably joined to a front auger section at a male and female joint of hexagonal cross-sectional shape.

Figure 3:
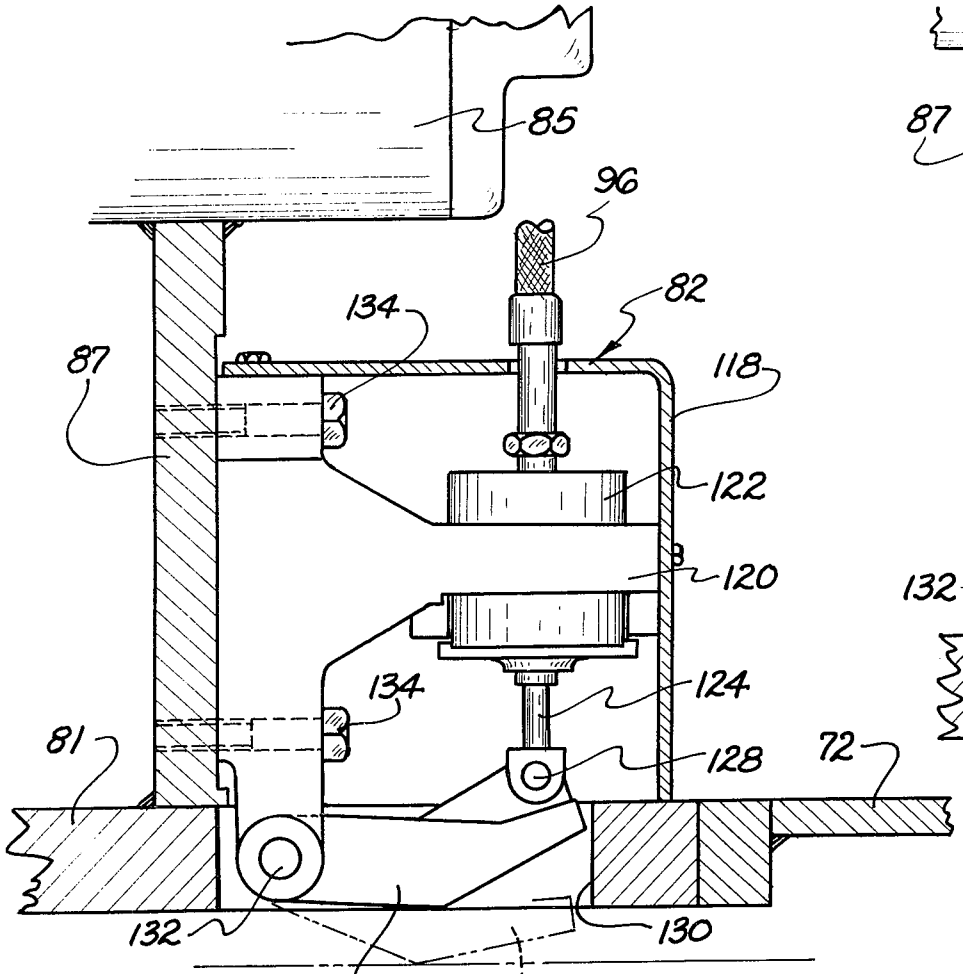
FIG. 3 is a side elevational view, partially in section, of a welding means comprising a portion of the apparatus of FIGS. 1 and 2.

With particular reference to FIGS. 2 and 3, the above mentioned steering head 80 comprises a plurality of circumferentially spaced wedging means indicated generally at 82 with four of such wedging means being utilized in the preferred embodiment and spaced at 90° intervals around the inner surface of the rock head housing ring 81.

Referring particularly to FIG. 3, one of the wedging apparatus is illustrated in enlarged detail and includes a bracket 120 mounted on a respective radial leg 87 by cap screws 134. Such bracket supports a hydraulic cylinder 122, which is shown as a single acting type including a return spring 198, FIG. 6, with such cylinder being fed with and exhausted of pressurized fluid via a flexible hydraulic line 96 which is extended back along the outer surfaces of the casing sections such as 72 and 76.

Each of the power cylinders includes a ram 124 which is pivotally attached to a wedging element 126 at a pivot pin 128, with such wedging element being in turn pivotally mounted to the previously mentioned bracket 120 at a wedge mounting pivot 132.

It will be noted from FIG. 3, that wedging element 126 is disposed in an opening 130 provided in housing ring 81 so as to be extendable and retractable outwardly and inwardly to engage and apply force to the surrounding rock surface of the hole being drilled.

Figure 5:
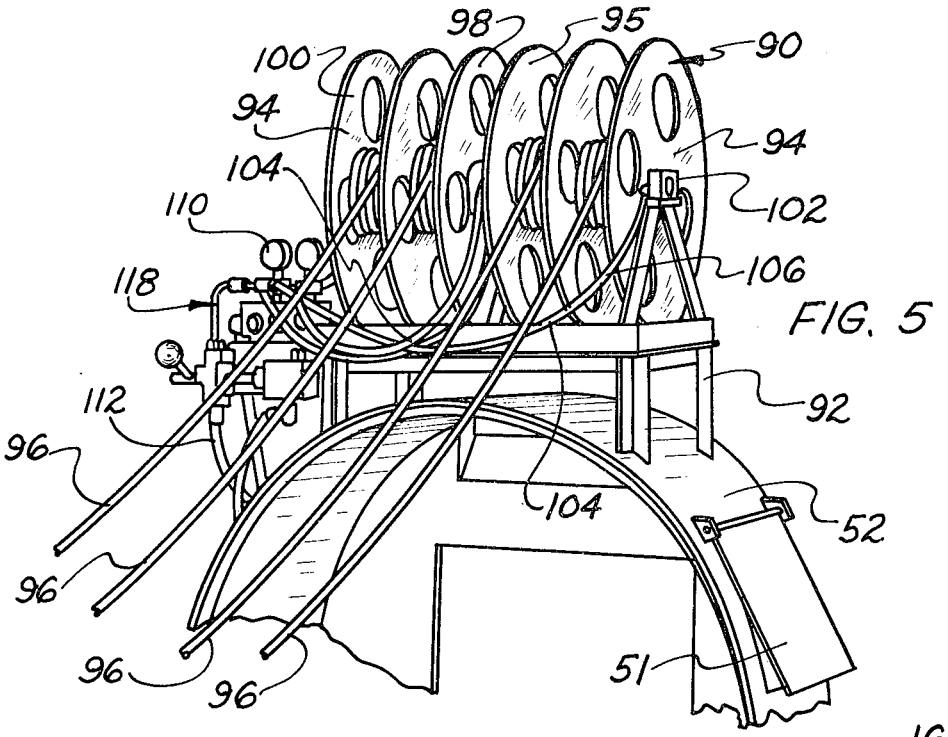
FIG. 5 is a partial front perspective view of a control system for the remotely controlled apparatus of FIGS. 1 and 2.

With continued reference to FIG. 3, each wedging apparatus is preferably provided with a removable housing 118 to protect the mechanism from drillings which continually progress rearwardly from rock head 150 and between the radial legs 87 to the auger blades which continually move the drillings rearwardly and outwardly through the discharge opening 51 in pusher ring 52, the latter being seen in FIG. 5.

Referring next to FIG. 5, the previously described fluid supply lines 96 are of flexible construction and normally stored on a reel assembly indicated generally at 90 which assembly includes the four separate spools 94, 95, 98 and 100, each of which is adapted to feed out and roll up a respective flexible hydraulic line 96 leading to a respective power cylinder 122.

With continued reference to FIG. 5, reel assembly 90 furhter includes a central manifold means 102 adapted to feed the flexible lines 96 with the manifold means being supplied with pressurized oil by respective conduits 104 each of which includes a respective control valve 200, 202, 204, and 206 as shown in FIG. 6.

With continued reference to FIG. 5, the reel assembly and a related control apparatus indicated generally at 118 are shown mounted on a control base 92, which is preferably located on the top of pusher ring 52 at the operator's station, but it can be located at any remote location without departing from the spirit of the present invention.

Reference is next made to FIG. 6 which diagrammatically illustrates the hydraulic circuit for the machine of the present invention. The pushing cylinder portion of the circuit, during high speed operation, includes a fixed displacement pump 210 adapted to supply pressurized hydraulic fluid to the previously mentioned pushing cylinders 162 via line 196, diverter valve 192, line 186, a three-way "high-low" speed control valve 176, line 172, and a four-way closed center control valve 164, the latter being connected to the pushing cylinders 162 via lines 166 and 168.

Directional control valve 164 includes a manual actuator 46 which can be shifted by the operator so as to either pressurize the base chambers of pushing cylinders 162 via line 168 or the rod ends of such pushing cylinders 162 via line 166. Hence it will be understood that valve 164 is used to either extend or retract the previously mentioned carriage 24 as well as pusher ring 52 so as to push the casing sections into the drilled holes.

The pushing cylinder portion of the circuit further includes a second fixed displacement pump 178 for low speed operation which is provided with an adjustable pressure relief valve 182 for establishing the maximum pressure delivered by pump 178, as well as a flow control valve 174. It will now be understood that the pushing cylinder portion of the circuit is adapted for both low and high speed operation by the availability of the second hydraulic pump 210 and the fluid flow from this pump can be added to the fluid flow delivered by the previously mentioned pump 178 by opening a three-way "high-low" speed control valve 176 when the operator actuates the manual actuator 44.

With continued reference to the circuit of FIG. 6, hydraulic pump 210 serves the added functions of powering and controlling the steering head 80 by supplying pressurized fluid to the previously mentioned power cylinders 122 which operate the wedging elements 126. This portion of the circuit includes a pressure relief valve 212 adapted to by-pass excess fluid back to reservoir 214 with pressurized fluid being delivered via line 196 to normally closed wedge control valves 200, 202, 204 and 206 each of which is adapted to selectively pressurize the base end of a respective power cylinder 122, with each of said cylinders being adapted to operate a respective wedging element 126 in the manner previously described.

As seen in FIG. 6, when it is desired to operate the steering head portion of the circuit, a shut-off valve 192 is shifted by the operator, by actuating lever 194, to its closed position whereby pressurized fluid is made available to the four wedge control valves with each of the said valves including a manual operator 110.

It should be further mentioned that when it is desired to operate the pushing cylinders 162 at high speeds then valve 192 is maintained open and the previously mentioned "high-low" speed control valve 176 is opened so as to deliver the additional fluid capacity from pump 210 into the pushing cylinder portion of the circuit. When it is desired to operate the pushing cylinders 162 at low speed operation, then actuator 44 is used to close "high-low" speed control valve 176 whereby only the volumetric flow from the other pump 178 is delivered to the pushing cylinders 162.

With continued reference to FIG. 6, it should be mentioned that the actuators for the wedging elements 126 include the return springs 198 thereby eliminating the need for a double acting power cylinder construction for wedge actuating cylinders 122.

It should further be mentioned that in the preferred embodiment, the wedging means 82 are preferably located at 90° intervals with their positions being at the right side, left side, top and bottom. Hence by pressurizing the left wedging cylinder and depressurizing the right wedging cylinder then the biasing effect of left wedge 126 will direct the rock head 150 and the lead casing section to the right. The converse will of course be true when the right wedge actuating cylinder 122 is pressurized and the left wedging cylinder is relieved. Moreover, when the upper wedging element is pressurized by its respective cylinder, with the lower wedging element being relieved, then the rock head and front casing section will be wedged downwardly with the opposite being true when the lower wedging cylinder 122 is pressurized and the pressure in the upper wedging cylinder is relieved. Moreover, when the upper wedging element is pressurized by its respective cylinder, with the lower wedging element being relieved, then the rock head and front casing section will be wedged downwardly, with the opposite being true when the low wedging cylinder 122 is pressurized and the pressure in the upper wedging cylinder is relieved.

Figure 4:
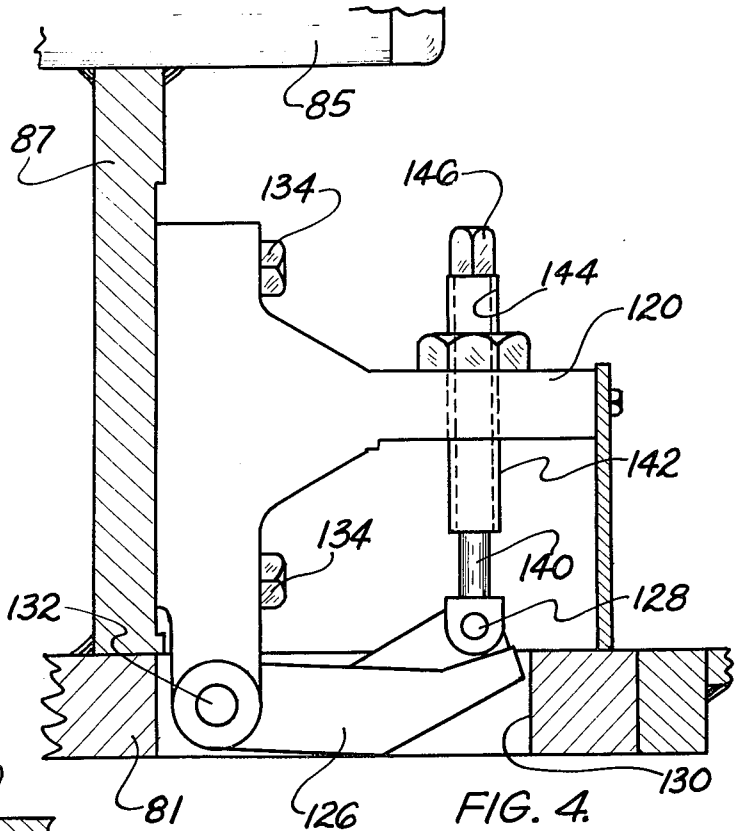
FIG. 4 is a partial side elevational view showing a modified manually operated wedging means for the machine of FIG. 1.

Reference is next made to FIG. 4 which illustrates a modified manually controllable steering apparatus which includes elements identical to those previously described in connection with the hydraulic embodiment of FIG. 3, with like elements being identified by identical numbers. Such manual embodiment does not require a hydraulic circuit and merely includes male and female screw elements 142 and 144, with the latter being mounted on bracket 120. Hence when the male element is rotated by application of a wrench to its head 146 then wedging element 126 is either extended or retracted depending on the direction of rotation. This manual steering apparatus, though less convenient, is operable where cost is a factor, and with larger casing sections where it is possible for the operator to remove the auger and crawl into the casing sections up to the forward end where the male screw members 146 can be actuated with a wrench as required to achieve the desired steering control.

Figure 7:
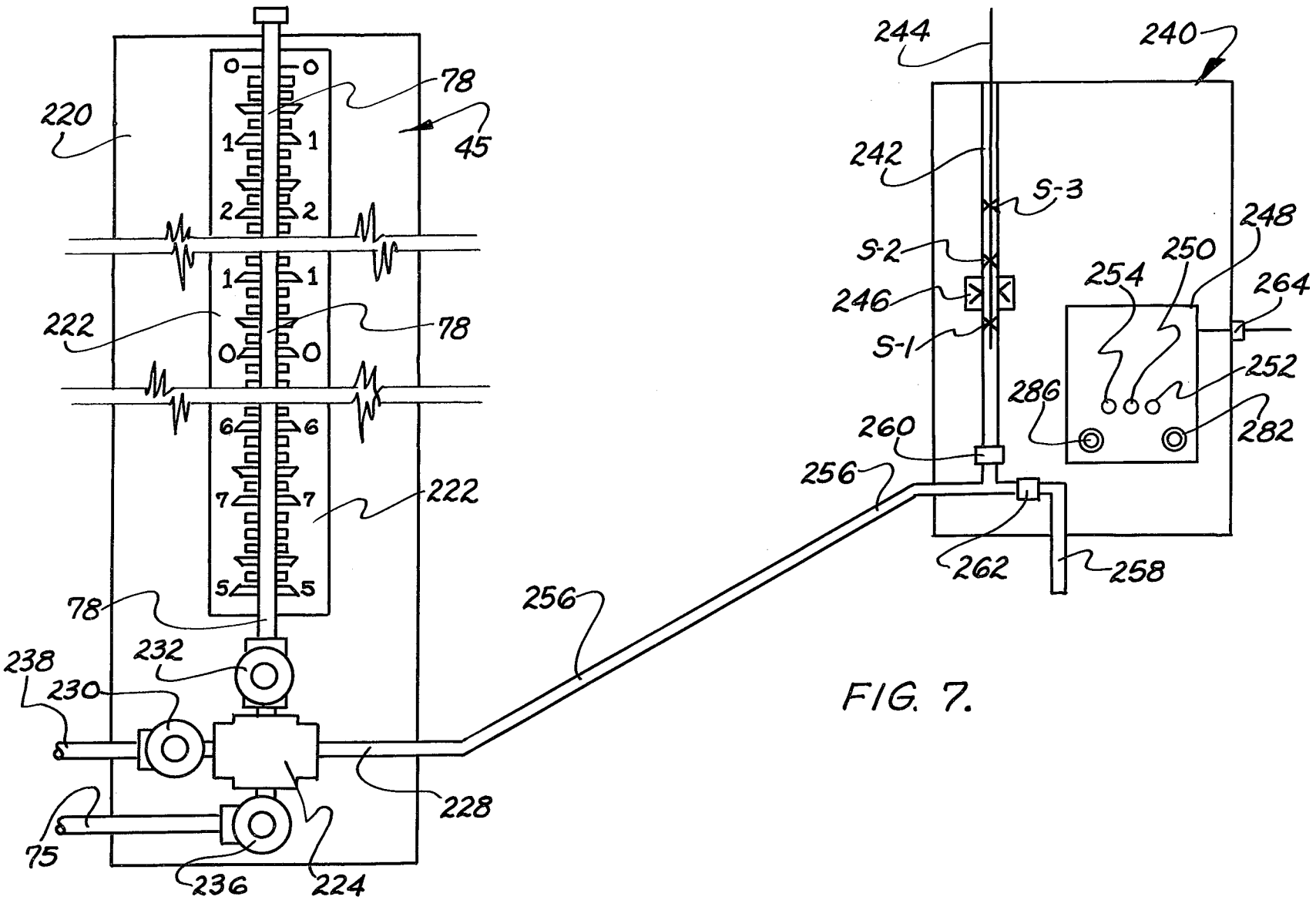
FIG. 7 is a front elevational view showing a remote grade indicating gauge and automatic control panel for the boring machine of the preceding figures.
Figure 8:
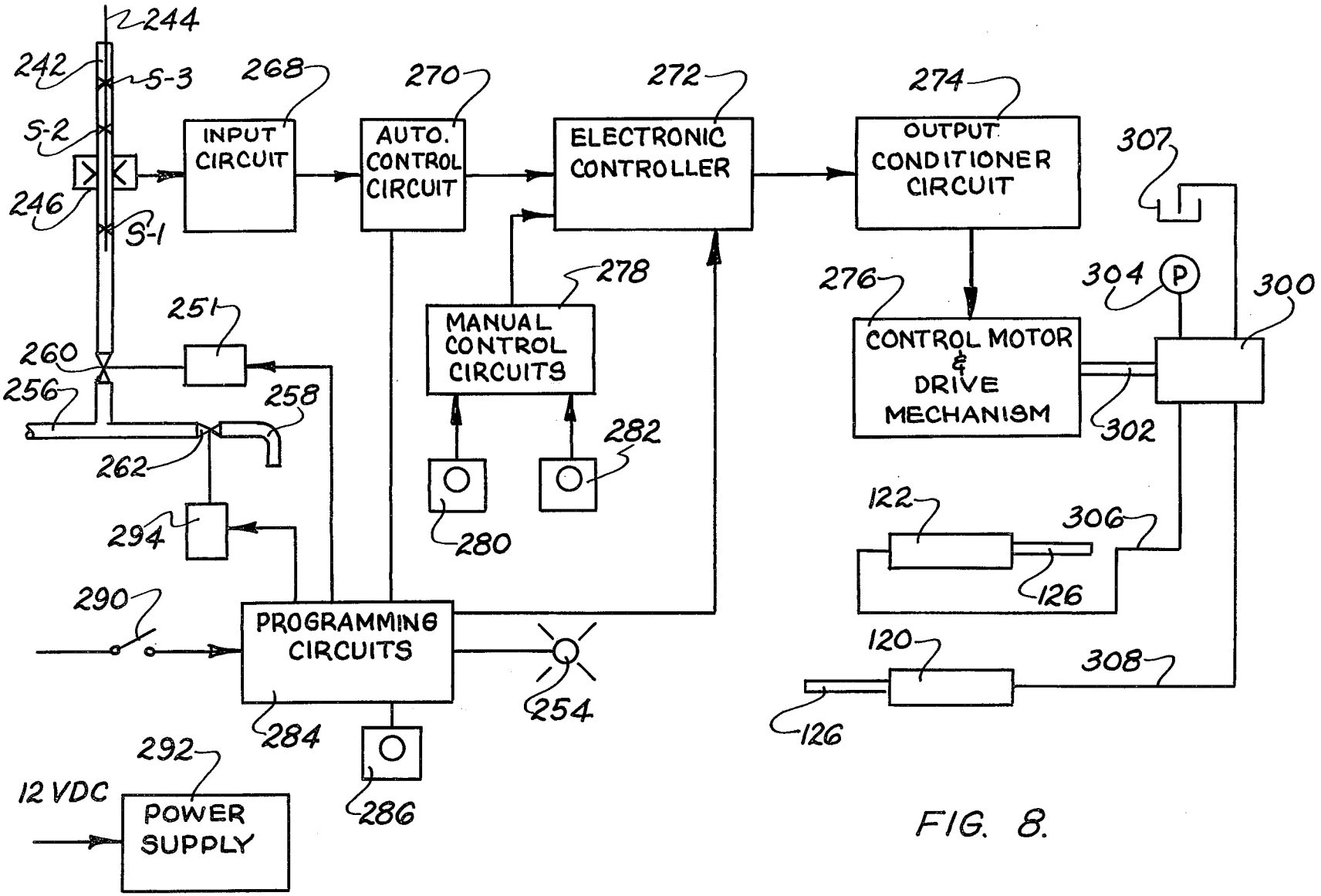
FIG. 8 is a diagrammatic view of a circuit for the automatic control system of the present invention.

Referring next to FIG. 7, the apparatus further comprises an automatic control panel indicated generally at 240 which includes electronic control circuits which are diagrammatically illustrated in the circuit of FIG. 8. This automatic system can be used to operate two of the previously described hydraulic cylinders 122 for the purpose of automatically maintaining the predetermined grade of the drilling operation. In this instance, the automatic control is applied to a "down power cylinder 122-D" which is mounted on the top of the heavy duty housing ring 81 and a "up power cylinder 122-U" which is mounted on the bottom of the heavy duty housing ring 81. Such power cylinders 122-D and 122-U are identical in construction to the power cylinders 122 shown in FIGS. 1–3.

Referring particularly to the control panel 240 the apparatus includes a control tube 242 which communicates with the previously described water gauge tube 78 of the gauge means 45 via a connecting tube 256 such that the water level in the control water tube 242 will at all times be equal to the water level in gauge tube 78, as well as equal to the water level at the sensing means 70.

Referring again to FIG. 7, the existing water level is sensed by a level control sensor rod 244 mounted in control tube 242 with such rod 244 including three axially spaced metal sensors diagrammatically represented at S-1, S-2, S-3. The lower sensor S-1 functions to sense a low water level which indicates that steering head 72 is working downwardly, whereas the middle sensor S-2 senses the high level of the water which in turn indicates that steering head 72 is working upwardly. The top sensor S-3 functions to sense when the water in control tube 242 is at a high enough level for the supply to be turned off so that the system can settle out for a reading.

Sensors S-1, S-2, and S-3, diagrammatically illustrated in FIGS. 7 and 8, are small wires or metal elements the electrical resistance of which changes upon emersion in water when the level in control tube 242 changes to cause such emersion. Such changes in electrical resistance function as input signals to comparers in input conditioning circuits 268.

The above mentioned sensors are connected to input conditioning circuit 268 by a loom of wires indicated diagrammatically at 246. When the water level reaches the metal sensors S-1, S-2, and S-3 the comparers in the input conditioning circuits 268 change state.

The system of FIG. 8 further includes an automatic control circuit 270 and an electronic controller 272 which effect a memory function and also control an output signal to a control motor and drive mechanism 276 with such output signal being selectively actuated by programming circuits 284.

Programming circuits 284 at the outset of operation serve to connect the system with a water supply via line 238 upon actuation of a solenoid 251 of a water inlet valve 260. This allows water to flow up into the water level control tube 242. Subsequently, after a time delay to permit the system to stabilize, the sensing circuits function to determine the water level in the water level control tube 242 with the information being electronically stored in the memory circuits. At this time one of the signal lights 254 comes on to indicate to the operator that the boring machine should be started. After the machine is operating a signal is sent from the memory circuits to the programming circuits which institute operation of the control motor 276 to effect the necessary movement of the steering head as indicated by the memory signals.

Referring again to FIG. 8, the circuit further includes an output conditioner 274 which consists of a group of power output circuits which drive control motor 276.

As seen in FIG. 8, the operation of the control system is activated by control button 286.

Another feature of the control circuit comprises a machine turning limit switch 290 which is connected to the programming circuits 284 for the purpose of limiting the movement of the steering head beyond a predetermined maximum angle.

Still another feature of the automatic control circuit of FIG. 8 consists of an optional manual control circuit 278 which is shown provided with an "up" manual control button 280 and a "down" manual control button 282 with respective lights 250 and 252.

As seen in FIG. 8, previously described cylinders 122, FIGS. 1–6, are selectively pressurized responsive to the appropriate control signal when control motor 276, FIG. 8, operates to shift an actuator 302 of a control valve 300.

When control motor 276 extends to shift actuator 302 to the right, then the "down" cylinder 122-D is pressurized with the "up" cylinder 122-U being connected to tank 307. Pressurization of "down" cylinder is effected by pressurized fluid from a pump 304 which may be driven by the boring machine. This extends top shoe 126 outwardly which in turn forces the front of the casing section downwardly to decrease grade.

Similarly, when control motor 276 shifts valve actuator 302 to the left, then the other cylinder 122-U or "up" cylinder is connected to pump 304 via valve 300 and at the same time "down" cylinder 122-D is connected to tank 307. This extends a bottom shoe 126 outwardly which forces the front of casing section 72 upwardly thereby increasing grade.

After a correction has been made, when the sensors detect that the steering head 72 is back on grade, then the circuits function to center valve 300 and the boring angle is maintained until the sensors detect that another correction of boring angle is required.

When it is desired to bleed the circuit, valve 262 is actuated via a solenoid 294 with such bleeding function being automatically controlled by the programming circuits 284.

Referring in detail to FIGS. 1 and 7, the remote sensing apparatus further includes a gauge means indicated generally at 45 that includes a transparent tube 78 mounted on a frame 220 in overlying relationship with an indicia scale 222 which includes the zero base and the related indicia marks which divides the scale into units, for example one-hundredths of a foot.

Gauge means 45 communicates with a water supply via a tube 238 which enters a valve 230 leading to fitting 224.

The apparatus further includes a valve 236 communicating with tube 75 that in turn is connected to the previously described sensing means 70.

The system is charged from supply tank via gravity through open valves 230, 236, 232 and 260. Valve 230 is closed when line 238 and 256 are full and free of air. Valve 236 is next closed and the valve 232 is closed when transparent tube 78 is full and valve 260 is closed when transparent tube 242 is full.

Valves 236, 232 and 260 are next opened and the water will seek its level in transparent tube 78 and 242 as dictated by the vertical location of sensing means 70.

In the event the boring is being conducted at a declined angle the water level will be established at the top of a right reference pin since water can bleed out of a sensor outlet until such level is established.

When the boring operation is being conducted at an inclined angle then the water level in gauge tube 78 and 242 will correspond with the top of the other reference pin.

At the outset of the boring operation, before steering head 72, and the gauge 70 mounted thereon, are buried in the earth fill, the apparatus is zeroed merely by placing a conventional surveyor stake, not illustrated, on top of one of the reference pins. The zero indicia mark on gauge 45 is then established at the same horizontal level as one of the reference pins by sighting along an indicia mark on indicia scale 222 and a corresponding mark on the surveyors stake.

The surveyors stake is then removed after zeroing the apparatus and the drilling and pushing operations are next commenced.

It should be mentioned that the outlet of the sensing means 70 is superimposed over a drain hole through the wall of steering head 72 to provide means for releasing water from the outlet.

It will now be understood that after sensing means 70 disappears into the earth fill, as seen in FIG. 1, the zero grade position of the steering head 72 will be present when the water level is at the zero mark on the indicia scale of gauge 45. Moreover, as the steering head 72 inclines or declines the exact amount of such angular change will be reflected by the water level in the transparent tube 78 and 242 of the gauge.

It should further be mentioned that in instances where the boring apparatus and associated grade indicating apparatus are to be temporarily removed from the earth fill and it is desired to come back to the job and re-operate the apparatus at the same reference, then in such instances a reference means bench mark can be driven into the earth fill adjacent to the gauge and the location of the zero reference on the gauge can be noted on the bench mark using a surveyors transit as a sighting means with such bench mark being left in the boring bed when the apparatus is temporarily removed therefrom. When the apparatus is returned, the operator merely needs to line up the zero on the gauge 45 with the mark location on the bench mark using the transit and the boring operation can be resumed with the same zero reference with respect to grade deviations.

While the forms of embodiments of the present invention as herein disclosed constitute preferred forms, it is to be understood that other forms might be adopted.

What is claimed is:

1. In an earth boring apparatus of the type that forms horizontal holes and pushes sections of casing into said holes, the combination of casing means comprising a lead casing section provided with a plurality of side openings; bearing means mounted in said lead casing section; a rock head mounting shaft journaled in said bearing means; a rock drilling head mounted on the forward end of said mounting shaft; a wedging means radially moveably mounted at each of said side openings and extendable outwardly therefrom; wedge driving means for said wedging means for extending and retracting said wedging means against and away from the rock surrounding said lead casing section; sensing means for progressive extension into the earth fill; gauge means for location adjacent the earth fill and connected to the sensing means, said gauge means including read-out indicia for informing the operator of grade deviations of the sensing means; and automatic control means for energizing said wedge driving means responsive to sensing of a deviation in grade by said sensing means.

2. The apparatus defined in claim 1 wherein said wedge driving means comprises a fluid motor.

3. In an earth boring apparatus of the type that forms horizontal holes and pushes sections of casing into said holes, the combination of casing means comprising a lead casing section provided with a plurality of side openings; bearing means mounted in said lead casing section; a rock head mounting shaft journaled in said bearing means; a rock drilling head mounted on the forward end of said mounting shaft; a wedging means radially moveably mounted at each of said side openings and extendable outwardly therefrom; wedge driving means for said wedging means for extending and retracting said wedging means against and away from the rock surrounding said lead casing section; sensing means for progressive extension into the earth fill and including a fluid passage for establishing a fluid level corresponding with grade deviations of the progression into the earth fill; gauge means for observation by the boring machine operator and including a gauge tube communicating with said fluid passage and containing a fluid, said gauge tube being provided with indicia, the level of the fluid in said gauge tube corresponding with said fluid level in said sensing means; and automatic control means for energizing said wedge driving means responsive to deviations in said fluid level.

4. The apparatus defined in claim 3 wherein said automatic control means includes a level control rod emersed in said fluid; and water level sensors on said control rod for sensing changes in water level caused by grade deviation of the lead casing section with respect to a preselected zero reference line.

5. The apparatus defined in claim 3 wherein said automatic control means includes sensing means emersed in said fluid, said sensing means comprising a lower sensor that senses downward movement of the fluid level in said gauge tube; a middle sensor that senses upward movement of said fluid level; and an upper sensor that senses a fluid level high enough for the grade indicating system to settle out for a reading.

6. In an earth boring apparatus of the type that forms horizontal holes and pushes sections of casing into said holes, the combination of casing means comprising a lead casing section; bearing means mounted in said lead casing section; a rock head mounting shaft journaled in said bearing means; a rock drilling head mounted on the forward end of said mounting shaft; wedging means on said lead casing section and including a moveably mounted wedging element laterally extendable and retractable relative to said casing section; a fluid motor for driving said wedging element; means forming a source of pressurized fluid in circuit with said fluid motor; motor control valve means for the flow of pressurized fluid in said fluid circuit; sensing means for progressive extension into the earth fill and including a fluid passage for establishing a fluid level corresponding with grade deviations of the progression into the earth fill; gauge means for observation by the boring machine operator and including a gauge tube communicating with said fluid passage and containing a fluid, said gauge tube being provided with indicia, the level of the fluid in said gauge tube corresponding with said fluid level in said sensing means; and automatic control means for operating said motor control valve means responsive to deviations in said fluid level.

7. The apparatus defined in claim 6 wherein said automatic control means includes a level control rod emersed in said fluid; and water level sensors on said control rod for sensing changes in water level caused by grade deviation of the lead casing section with respect to a preselected zero reference line.

8. The apparatus defined in claim 7 wherein said automatic control means includes sensing means emersed in said fluid, said sensing means comprising a lower sensor that senses downward movement of the fluid level in said gauge tube; a middle sensor that senses upward movement of said fluid level; and an upper sensor that senses a fluid level high enough for the grade indicating system to settle out for a reading.

* * * * *